US006588037B1

(12) United States Patent
Eno et al.

(10) Patent No.: US 6,588,037 B1
(45) Date of Patent: Jul. 8, 2003

(54) PORTABLE SUPPORT FOR A MOSQUITO NET

(75) Inventors: David Eno, Los Angeles, CA (US); Sunook Park, Los Angeles, CA (US); Il Han Moon, Seoul (KR)

(73) Assignee: Tropical Safety Research, Inc., Los Angeles, CA (US)

( * ) Notice: Subject to any disclaimer, the term of this patent is extended or adjusted under 35 U.S.C. 154(b) by 0 days.

(21) Appl. No.: 10/127,774

(22) Filed: Apr. 22, 2002

(51) Int. Cl.[7] ..... A47C 29/00

(52) U.S. Cl. ..... 5/419; 5/659; 5/505.1; 135/90

(58) Field of Search ..... 5/414, 504.1, 505.1, 5/659; 135/90

(56) References Cited

U.S. PATENT DOCUMENTS

| | | | |
|---|---|---|---|
| RE1,816 | E | 11/1864 | Palmer |
| 86,966 | A | 2/1869 | Armstrong |
| 87,589 | A | 3/1869 | Platt |
| 180,732 | A | 8/1876 | Schapker |
| 364,415 | A | 6/1887 | Hooper |
| 503,954 | A | 8/1893 | Gerson |
| 665,126 | A | 1/1901 | Palmer |
| 692,419 | A | 2/1902 | Broun |
| 1,565,191 | A | 12/1925 | Nelson |
| 3,751,741 | A | 8/1973 | Hendry |
| 4,852,598 | A | 8/1989 | Griesenbeck |
| 4,884,306 | A | 12/1989 | Goetz |
| 6,145,141 | A | 11/2000 | Whittington et al. |

FOREIGN PATENT DOCUMENTS

| | | | |
|---|---|---|---|
| WO | WO 94/10882 | * | 5/1994 |

* cited by examiner

*Primary Examiner*—Michael F. Trettel
(74) *Attorney, Agent, or Firm*—Michael R. Philips

(57) ABSTRACT

The present invention provides a portable support device adapted for being disassembled into segments for packing and being readily assembled. The support device in a first embodiment has a base block to which a pair of arms is assembled and to which a segmented pole is mounted in vertical orientation to support a mosquito net. In a second embodiment, an arm is assembled to a beam to define a horizontal plane and a segmented pole is assembled to the beam in a vertical orientation without use of a connecting block. In third and fourth embodiments, a pair of horizontal members are connected to each other and to a vertical support pole by a rigid connector. According to a third embodiment, a junction piece having two studs extending in a horizontal plane and a third stud in vertical orientation with an arm mounted to each of the horizontal studs and a pole mounted to the vertical stud to form a support apparatus. In a fourth embodiment, a first horizontal arm is assembled by a perpendicular connector to a vertical pole and a second horizontal arm is assembled to the first horizontal arm, forming a base for support between a mattress and a surface.

17 Claims, 5 Drawing Sheets

PORTABLE SUPPORT FOR A MOSQUITO NET

FIELD OF THE INVENTION

The present invention relates generally to a mosquito net support apparatus, and more particularly to a portable support for a mosquito net that is easily carried and quickly assembled and disassembled for use by travelers and in private homes, hotels and hospitals.

BACKGROUND OF THE INVENTION

In today's international business climate, and due to the relative ease of long distance travel, more people than ever are traveling to countries throughout the world. However, in some of these countries insect populations are not well controlled and the occurrence of insect-carried human disease is high.

Mosquito nets can provide an enclosed and substantially insect-free space to protect people from being bitten by mosquitoes or other flying insects. A mosquito net and support apparatus as disclosed herein is useful for travelers for protection while sleeping in areas infested by flying insects. In addition such apparatus is useful by hospitals and hotels to protect residents and allow easy portability from room to room.

An example of prior art related to mosquito nets and mosquito net devices is U.S. Pat. No. 87,589 of Platt which discloses a mosquito net device having a rigid single pole with a lower end fixedly attached to the bed frame head. A loop structure is attached to the upper end of the mosquito net device to better drape the netting around a bed.

U.S. Pat. No. 1,816 of Palmer discloses a pole of adjustable length and attached at its lower end to a "V" shaped base that rests on the floor underneath the bed. Other examples of patents that disclose mosquito net support devices used in connection with beds are U.S. Pat. Nos. 180,732; 364,415; 503,954; 665,126; 1,565,191; 3,751,741; 4,884,306 and 6,145,141.

It would be advantageous for people traveling to countries with a high degree of mosquito infestation to carry a mosquito net apparatus that is portable and compact so as to be able to be stored in a small travel bag or suitcase, and that can be easily assembled (and disassembled) and attached to a bed.

Therefore, it is an object of the present invention to provide a portable mosquito net support apparatus that is especially adapted to be carried in a travel bag or suitcase.

It is a further object of the present invention to provide a portable mosquito net apparatus for use in homes, hospitals and hotels for ease in movement from room to room.

It is another object of the present invention to provide a portable, collapsible mosquito net support apparatus that is compact when collapsed.

It is still another object of the present invention to provide a portable mosquito net support apparatus that can be easily and quickly assembled and disassembled.

SUMMARY OF THE INVENTION

According to the present invention, a portable support apparatus for a mosquito net includes a frame having a portion that fits between a mattress and a mattress support surface, for example, a bed spring assembly. The frame portion is placed approximately one-third down from the head of the bed along one side of the mattress. The weight of the mattress holds the frame portion between the mattress and the mattress support surface. The frame also includes a base block that extends beyond the mattress periphery. Where the user of the present invention is sleeping or resting without a mattress, the frame portion is facing away from the user and held in position by a suitcase or other weight, or may be held by pegs driven into ground. An elongate pole with a curved upper end is attached to the base block such that the pole's upper end is positioned over the mattress and includes a hook for support of a mosquito net. The mosquito net has a central ring with straps attached to the cap's top. The straps terminate in a loop that is attached to the pole's end-hook such that the mosquito net is draped over the bed to form an enclosed space protecting an occupant of the bed from insects located exterior to such space. The frame, pole, and mosquito net components of the invention are quickly assembled and disassembled, and once disassembled are easily packed inside a person's travel bag or suitcase for convenient transport from one location to another.

In a second embodiment, the frame only includes tubular members, without a base block connection piece. A first tubular member is drilled with cross holes to mount a second tubular member in the same plane and a third tubular member as a support pole perpendicular to the first plane.

In a third and a fourth embodiment, the frame portion is assembled to the elongate pole by a bent rod junction piece.

DETAILED DESCRIPTION OF THE INVENTION

Figure 1:
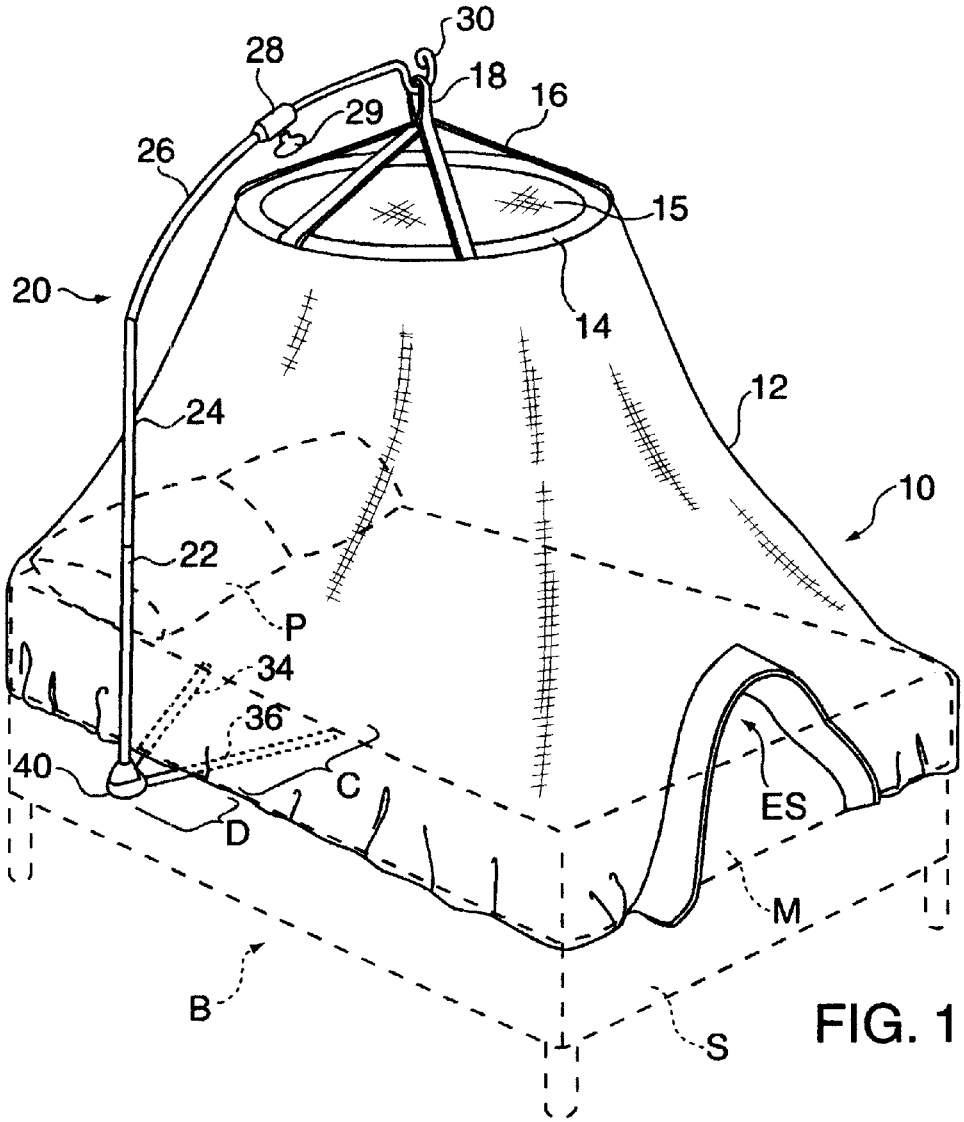
FIG. 1 is a perspective view of the portable mosquito net support apparatus of the present invention illustrated in use supporting a mosquito net over a conventional bed, shown in dashed lines.

As seen in the accompanying drawings, FIG. 1 portrays a mosquito net 10 being supported by a pole 20. Pole 20 is held in vertical orientation at its lower portion by a base block 40 from which portion C of a pair of bars 34 and 36 extend horizontally and be held securely between spring S and mattress M of bed B. Base block 40 and pole 20 remain beyond the edge of mattress M (portion D). One or more pillows P are shown on mattress M. The weight of mattress M serves to hold bars 34 and 36 substantially horizontal, with the lower portion of pole 20 extending vertically upward from base block 40. Base block 40 and bars 34 and 36 are described in greater detail below. Alternatively, the mosquito net support of the invention is secured by weighting or otherwise securing portion C of bars 34 and 36 oriented outwardly of the user when situated on a floor or the ground and used without a mattress.

Figure 2:
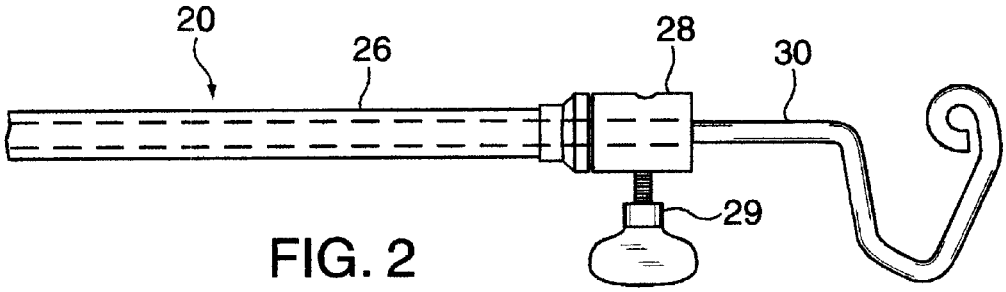
FIG. 2 is a partial view of the upper end of the net supporting pole showing in detail the telescoping extension with end-hook of the present invention.

Pole 20 is formed of straight segment 22, straight segment 24 and curved segment 26. The ends of pole segments 22, 24 and 26 are configured to interengage with one another. The outer end of curved segment 26 has a connector 28 assembled thereto. Connector 28, shown in greater detail in FIG. 2, is formed to slideably receive and firmly hold an extensible hook 30. By adjustment of clamp screw 29, hook 30 can be variably positioned to reside over the approximate center of mattress M, as is desirable for maximum closure. The degree of curvature of curved segment 26 and the stem portion of hook 30 places hook 30 at a height above mattress M so that mosquito net 10 (FIG. 1) drapes adequately around mattress M.

Mosquito net 10 is formed of a netting material 12 with openings that are large enough to allow air to pass but small enough to exclude insects, particularly mosquitos. The center of netting material 12 is draped over a ring 14 that serves to keep net 10 spread broadly when positioned as illustrated over mattress M. Ring 14 is formed of a resilient material that is biased to maintain a circular shape and can be twisted back on itself into a double ring of smaller diameter. Ring 14 is suspended from a series of straps 16 whose upper ends are held together and joined to a loop 18 that is configured to engage hook 30. The length of mosquito net 10 is sufficient to contact the side surfaces of mattress M when supported by hook 30. Entry section ES is illustrated in its open condition to allow a user to enter the protected area under mosquito net 10, then the net material 12 drapes down over mattress M to fully enclose the user.

When the user of the portable support of the present invention is sleeping on the ground rather than in a bed, bars 34 and 36 are positioned outwardly of a ground cloth or sleeping bag (not shown) and pole 20 and mosquito net 10 are positioned appropriately. Bars 34 and 36 are thus secured by a weight or by pegs driven into the ground.

Figure 3:
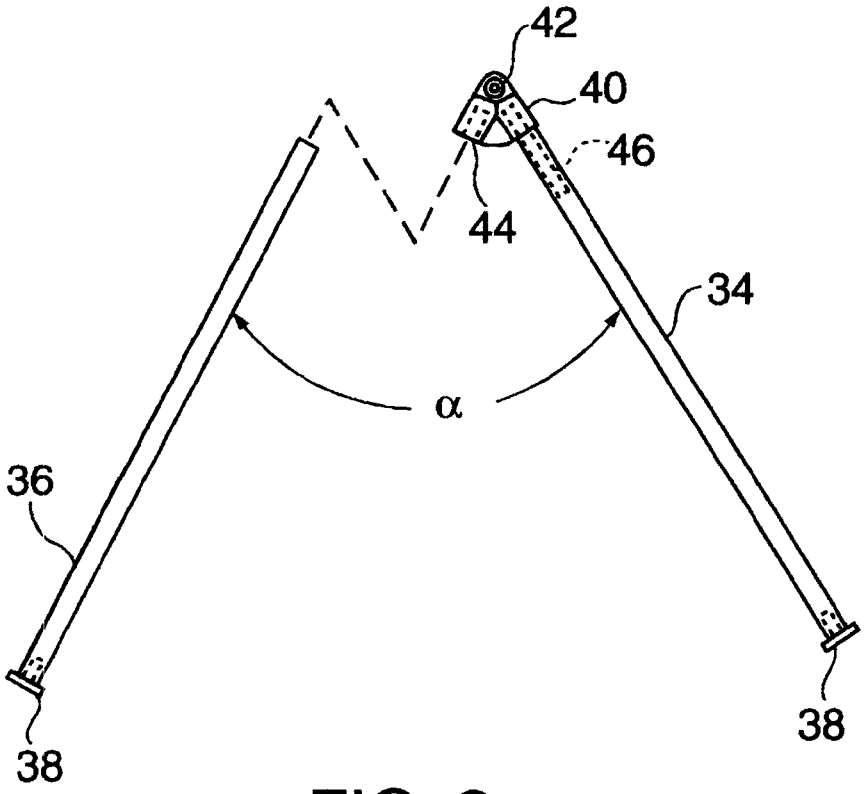
FIG. 3 is a partially exploded plan view of a two-member base block frame of the present invention.
Figure 4:
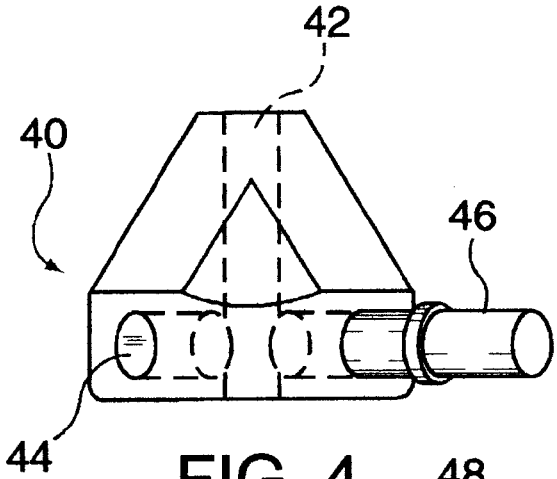
FIG. 4 is an enlarged front elevation view of the pole receiving support member of the two member frame of FIG. 3.

Referring now to FIG. 3, a top plan view is shown of base block 40 and bars 34, 36 with arm 36 separated for descriptive purposes. In the preferred embodiment, bars 34 and 36 are each formed from a length of hollow tubular stock. The tube of arms 34 and 36 may optionally be round or another crosssectional shape. A cap 38 is snugly mounted to the distal end of each of bars 34 and 36, either internally or externally. Cap 38 has a maximum diameter that is greater than the width of bars 34 and 36 so as to grip spring S and mattress M (see FIG. 1) when so mounted. As seen in FIG. 3 and FIG. 4, a stud 46 extends outwardly from base block 40. Block 40 is preferably formed either by molding or casting processes, as are known. Frictional gripper 48, for example an o-ring, is snugly inserted into an appropriate groove in stud 46 to grip bar 34 when so assembled. Bars 34 and 36 are thus residing relative to each other at angle $\alpha$, e.g. 30°. Bar 34 is configured for mounting on stud 46. Second bar 36 is preferably fixedly inserted into socket 44. When the invention support apparatus is disassembled and packed, the pole segments and bars are readily packed together. In another configuration, both of bars 34 and 36 may be removable.

As seen in FIG. 4, base block 40 has a bore 42 that is oriented substantially perpendicular to the plane defined by socket 44 and stud 46. Optionally, an elastic cord (not shown) is threaded through segments 22, 24, and 26 of pole 20. Straight segment 22 of pole 20 (see FIG. 1) is supported in bore 42 when the support device of the invention is assembled for use.

When disassembled, pole segments 22, 24, and 26 and hook 30 are packed with bar 34 and the assembly of base block 40 and bar 36. In its disassembled condition, the support apparatus of the invention is able to be packaged into a bag for easy transporting.

Figure 5:
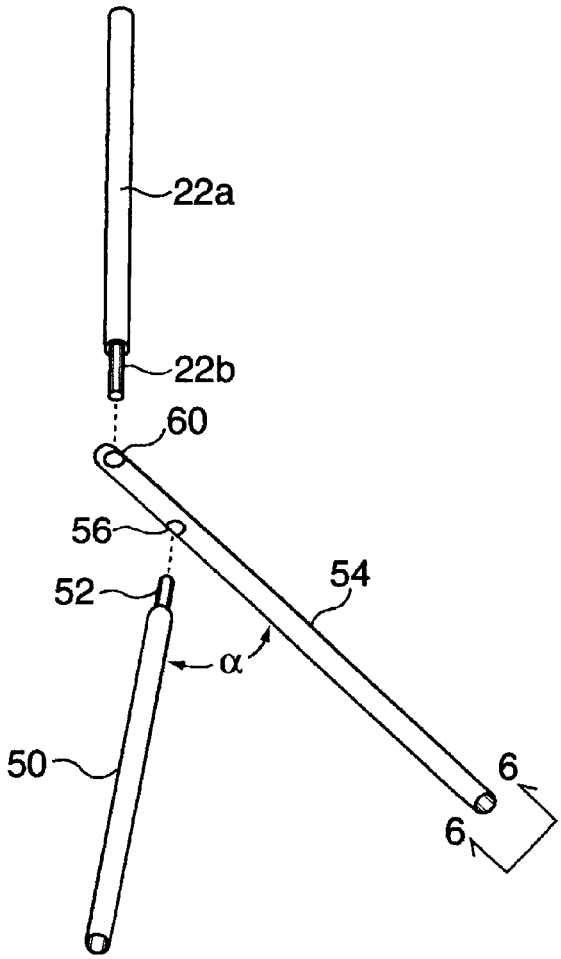
FIG. 5 is an exploded perspective view of a lower portion of a second embodiment of the invention.
Figure 6:
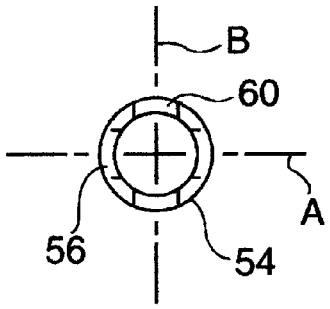
FIG. 6 is an end view of a beam member of the second embodiment as taken in the direction of line 6—6 of FIG. 5.

A second embodiment of the invention is illustrated in FIGS. 5 and 6. This second embodiment provides means for readily assembling two tubular members at an angle to one another to form a base unit and a third tubular member at a right angle to the first two as the lower portion of the mosquito net support pole as described in relation to the first embodiment.

Beam 54 is preferably formed of tubular material with two holes 56 and 60 therethrough. Hole 56 is drilled in a horizontal plane and at an angle a to beam 54. Hole 60 is drilled vertically and orthogonal to beam 54 at a distance from hole 56 such that when the base formed of assembled beam 54 and arm 50 is inserted between a mattress and a support surface, a pole inserted into hole 60 resides beyond the periphery of the mattress. FIG. 6 is an end view of beam 54 taken in the direction of line 6—6 of FIG. 5 and shows the horizontal orientation of hole 56 relative to the vertical orientation of hole 60.

Referring again to FIG. 5, arm 50 is preferably formed of tubular material that is optionally the same diameter as, or a smaller diameter than the diameter of beam 54. A narrow tip 52 is formed at one end of arm 50 of a diameter to enable snug engagement into hole 56 in beam 54. The difference in diameter in arm 50 and tip 52 controls the length position of arm 50 relative to beam 54. Alternatively, arm 50 is formed of a uniform diameter with a flange or pin mounted at a position adapted for controlling the depth of insertion into hole 56. The length of arm 50 is configured to substantially extend a similar distance from hole 60 as does the distal end of beam 54, when arm 50 is assembled thereto. Pole segment 22*a* is illustrated as the bottom portion of pole 20, described above in respect to FIG. 1. Pole segment 22*a* is formed for this second embodiment with a tip 22*b* at one end thereof for the same reason as tip 52 of arm 50. A flange or cross pin can be used similarly, as discussed above. Additional segments of pole 20 are to be added above pole segment 22*a* to support a mosquito net or other object. Optionally, the distal ends of arm 50 and beam 54 are fitted with a cap as described in reference to the first embodiment for increasing the security of engagement of the portable support apparatus of the invention with a mattress and its support ting surface. When disassembled into its components, this described second embodiment is also readily packaged for travel.

Figure 8:
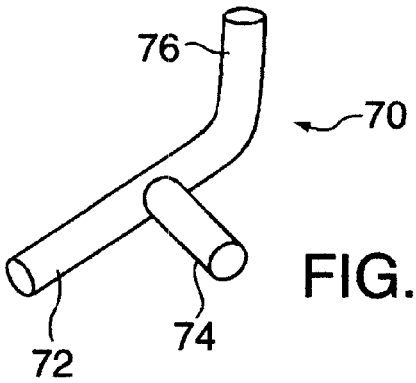
FIG. 8 is an enlarged perspective view of a junction component for the embodiment illustrated in FIG. 7.
Figure 7:
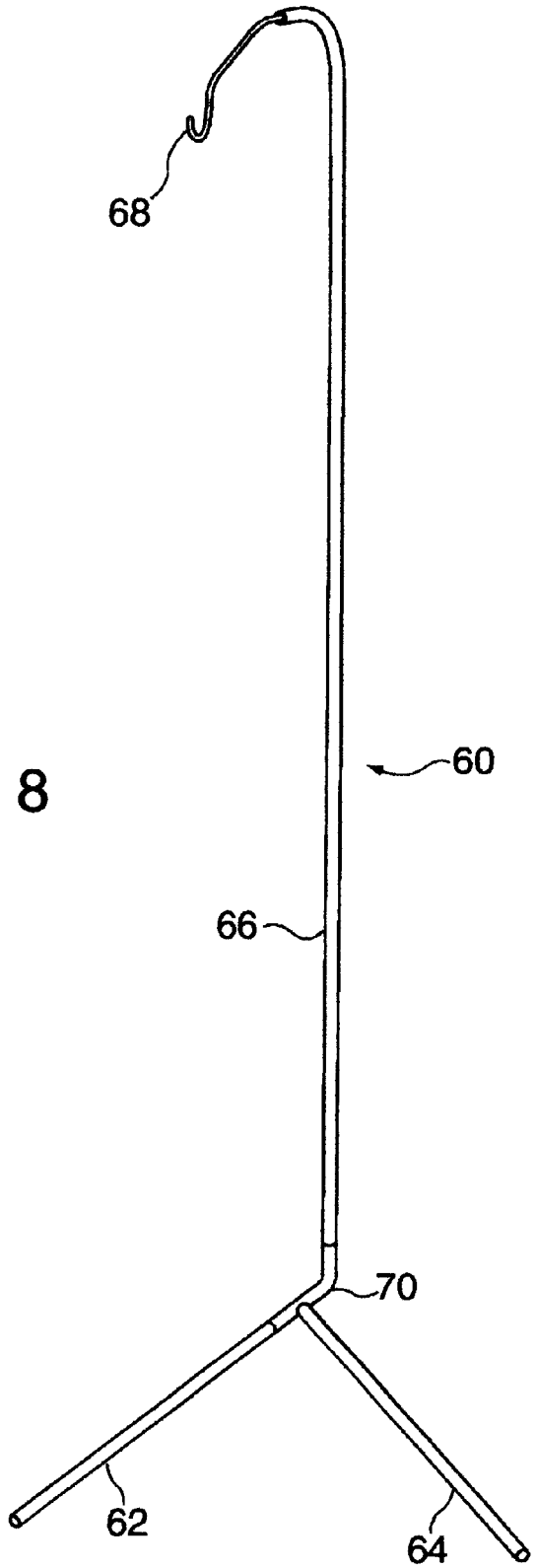
FIG. 7 is a perspective view of an assembly of a third embodiment of the invention.

A third embodiment of the present invention is illustrated in FIGS. 7 and 8. Support device 60 has first arm 62 and second bar 64 that are connected to one another at an acute angle K to reside in use in a horizontal plane. Arms 62 and 64 are to be placed beneath a mattress and upon a supporting surface for the mattress, e.g. a box spring unit. A frictional cap (not shown) is optionally assembled to the outer end of each of first arm 62 and second bar 64 to improve the grip between mattress M and support S (FIG. 1). A pole 66 is connected in perpendicular relation to the plane defined by arms 62 and 64 to extend vertically upwardly, terminating at its upper end with a curved portion having a hook 68 assembled thereto. Arms 62 and 64 and pole 66 are mutually connected with junction piece 70, shown in enlarged perspective detail in FIG. 8. Junction piece 70 is preferably integrally formed, preferably by casting or similar process in a material sufficiently rigid to maintain the desired angular relations between the components of support device 60. Junction piece 70 has comparable appendages, specifically horizontal stem 72, horizontal stem 74 and vertical stem 76. In order to prevent relative rotation therebetween and prevent loss of a small component, arm 62 is fixedly assembled to horizontal stem 72 by known means. Alternatively, a slot may be provided in an one of arm 62 or horizontal stem 72 with a mating pin provided in the other to prevent rotation, while allowing disassembly. A gripper (not shown) may be mounted to horizontal stem 74 to more firmly engage arm 64 when mounted thereto. Pole 60 is preferably provided as a set of short tubes, each one having one end adapted to be inserted to a mating end of another. For example, a first end of a first tube is similar in outer diameter to a second end of a second tube, enabling the first tube first end to be inserted into the second tube's second end. According to this arrangement, the several tubes making up pole 60 and arm 64 are removed from the assembly of arm 62 and junction 70 to enable all parts to be packaged for transport.

Figure 10:
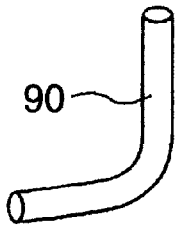
FIG. 10 is an enlarged perspective view of an L connector component of the fourth embodiment illustrated in FIG. 9.
Figure 11:
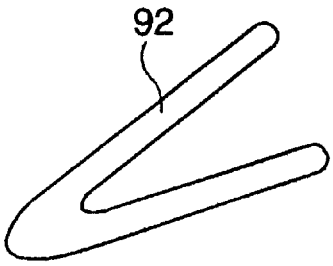
FIG. 11 is an enlarged perspective view of a V connector component of the embodiment illustrated in FIG. 9.
Figure 9:
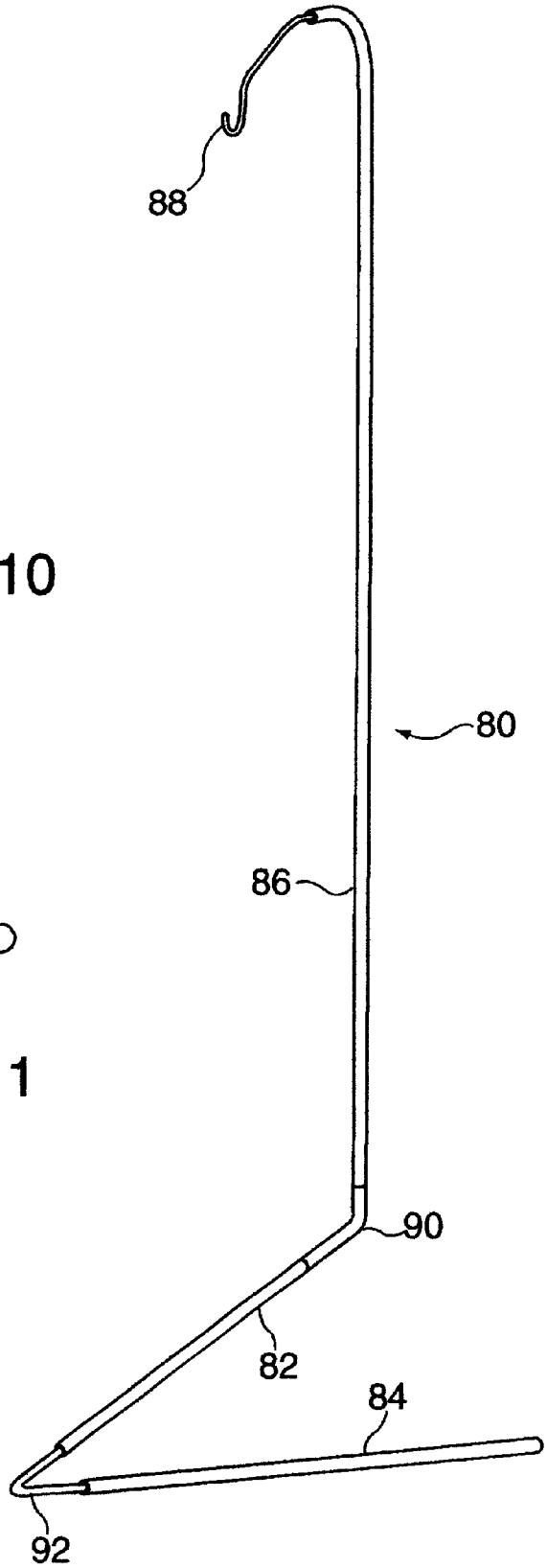
FIG. 9 is a perspective view of an assembly of a fourth embodiment of the invention.

A fourth embodiment of the invention is shown as support device 80 in FIGS. 9, 10 and 11. According to this fourth embodiment, arms 82 and 84 are connected to one another by V connector 92 so as to lie in a common horizontal plane. V connector and arm 82 are preferably fixedly assembled to one another. Pole 86, formed of a set of short interengaging tubes, is assembled in perpendicular relation to the plane of arms 82 and 84 by L connector 90. L connector 90 is preferably fixedly assembled to arm 82. With V connector 92 and L connector 90 affixed to arm 82, relative rotation between pole 86 and arm 82 is avoided. As shown in detail in FIG. 10, L connector 90 is an integral right angle component of rigid material. V connector 92, shown in FIG. 11 is similarly an integral component of rigid material forming an acute angle between its two stems. L connector 90 and V connector 92 may be cast or bent from rod stock. Pole 86 is formed as poles described hereinabove.

While the present invention is described with respect to specific embodiments thereof, it is recognized that various modifications and variations may be made without departing from the scope and spirit of the invention, which is more clearly and precisely defined by reference to the claims appended hereto.

What is claimed is:

1. A portable support for a mosquito net, comprising:

(a) a connector having first mounting means comprising a socket extending into the connector with an axis, second mounting means comprising a stud extending outwardly of the connector with an axis oriented at an angle to the axis of the first mounting means and third mounting means with an axis oriented in a direction substantially perpendicular to a plane defined by the first and second mounting means axes;

(b) a first bar assembled outwardly of the first mounting means;

(c) a second bar assembled outwardly of the second mounting means; and (d) a pole assembled outwardly of the third mounting means and configured to support the mosquito net over a surface on which the portable support rests.

2. The portable support as described in claim 1, wherein the pole comprises a hook for attaching the mosquito net for support over the surface.

3. The portable support as described in claim 2, wherein the hook is adapted for being adjustably positioned in relation to the pole.

4. The portable support as described in claim 1, wherein the third mounting means comprises a bore into the connector.

5. The portable support as described in claim 1, wherein the third mounting means comprises a stud.

6. The portable support as described in claim 1, wherein the first bar is fixedly assembled to the first mounting means, the second bar is removably assembled to the second mounting means and the pole is removably assembled to the third mounting means.

7. The portable support as described in claim 1, wherein the pole is divided into plural pole segments that are configured for interengagement with one another.

8. A portable support for a mosquito net, comprising:

(a) a connector having first mounting means with an axis, second mounting means with an axis oriented at an angle to the axis of the first mounting means and third mounting means with an axis oriented in a direction substantially perpendicular to a plane defined by the first and second mounting means axes;

(b) a first bar assembled outwardly of the first mounting means;

(c) a second bar assembled outwardly of the second mounting means;

(d) a pole assembled outwardly of the third mounting means and configured to support the mosquito net over a surface;

(e) a first cap mounted to a distal end of the first bar; and (f) a second cap mounted to a distal end of the second bar.

9. A portable support for a mosquito net, comprising:

(a) a connector having first mounting means with an axis, second mounting means with an axis oriented at an angle to the axis of the first mounting means and third mounting means with an axis oriented in a direction substantially perpendicular to a plane defined by the first and second mounting means axes;

(b) a first bar assembled outwardly of the first mounting means;

(c) a second bar assembled outwardly of the second mounting means; and (d) a pole assembled outwardly of the third mounting means and configured to support the mosquito net over the surface;

(d) wherein the second mounting means comprises frictional gripping means for securely holding the second bar.

10. A portable support for a mosquito net, comprising:

(a) a beam residing in a first plane;

(b) an arm connected at one end thereof to the beam such that the arm is coplanar with and at an angle to the beam;

(c) wherein the beam and the arm when connected are configured for being positioned between a mattress and a supporting surface therefor with an end of the beam extending beyond an edge of the mattress;

(d) a pole connected at one end thereof to the extending end of the beam, the pole having means for attaching the mosquito net for support over the surface, and oriented substantially perpendicular to a plane defined by the beam and the arm; and (e) wherein the beam is formed with a first hole for receiving an end of the arm and a second hole for receiving an end of the pole and the respective ends of the arm and the pole are configured with a tip configured for engagement with the respective hole.

11. The portable support as described in claim 10, wherein the pole comprises a hook for attaching the mosquito net over the surface.

12. The portable support as described in claim 10, wherein the pole is divided into plural pole segments that are configured for interengagement with one another.

13. The portable support as described in claim 10, wherein a first cap is mounted to a distal end of the beam and a second cap is mounted to a distal end of the arm.

14. A portable support for a mosquito net, comprising:

(a) an integrally formed junction piece having a first linear stem, a second linear stem connected to the first linear stem at an intermediate point thereof such that the first and second linear stems define a horizontal plane, and a third linear stem connected at a first end thereof to the first linear stem and oriented substantially perpendicular to the plane;

(b) a first bar assembled to a second end of the first linear stem;

(c) a second bar assembled to a distal end of the second linear stem; and (d) a pole connected at one end thereof to the third linear stem so as to extend vertically therefrom, the pole being segmented and having mosquito net supporting means at a distal end thereof.

15. The portable support as described in claim 14 wherein the junction piece is formed integrally by molding or casting.

16. A portable support for a mosquito net, comprising:

(a) a first connector formed as a pair of studs connected to each other at one end of each and extending at a right angle to one another;

(b) a second connector formed as a pair of studs connected to each other at one end of each and extending at an acute angle to one another;

(c) a first arm and a second arm assembled to respective studs of said second connector to define a substantially horizontal plane;

(d) a distal end of said first arm assembled to a first stud of the first connector;

(e) a pole assembled to a second stud of the first connector, the pole connected for supporting a mosquito net.

17. The portable support as described in claim 16 wherein the first and second connectors are fixedly assembled to one of the arms.

* * * * *